US007363923B2

(12) United States Patent
Czajka et al.

(10) Patent No.: US 7,363,923 B2
(45) Date of Patent: Apr. 29, 2008

(54) COOKING RANGE ASSEMBLY AND MONOLITHIC DRIP PAN

(75) Inventors: Charles Czajka, Forest Hill, MD (US); Philip Joseph Pio Vincenty, Ellicott City, MD (US)

(73) Assignee: Illinois Tool Works Inc., Glenview, IL (US)

( * ) Notice: Subject to any disclaimer, the term of this patent is extended or adjusted under 35 U.S.C. 154(b) by 27 days.

(21) Appl. No.: 11/030,654

(22) Filed: Jan. 5, 2005

(65) Prior Publication Data

US 2006/0144253 A1 Jul. 6, 2006

(51) Int. Cl.
*F24C 15/08* (2006.01)

(52) U.S. Cl. ..... 126/39 B; 99/446; 126/51

(58) Field of Classification Search ..... 126/214–216, 126/14 R, 14 A, 39 M, 403, 406, 40, 41, 126/41 R, 39 E, 211, 51; 99/446, 324, 444, 99/399 D; 431/343, 354; D7/407–409, D7/359; 219/622
See application file for complete search history.

(56) References Cited

U.S. PATENT DOCUMENTS

| | | | | | |
|---|---|---|---|---|---|
| 478,295 | A | | 7/1892 | Squire et al. | |
| 1,012,054 | A | | 12/1911 | Berry | |
| 1,085,671 | A | | 2/1914 | Day | |
| 1,649,006 | A | * | 11/1927 | Wilcox | 126/214 C |
| 2,105,340 | A | | 1/1938 | Yeager | 126/38 |
| 2,257,399 | A | | 9/1941 | Parker et al. | 126/39 |
| 2,320,754 | A | | 6/1943 | Sherman | 126/39 |
| 2,429,279 | A | * | 10/1947 | Salter et al. | 126/214 R |
| 2,507,661 | A | * | 5/1950 | Cook et al. | 126/39 B |
| 2,530,991 | A | * | 11/1950 | Reeves | 126/214 C |
| D169,719 | S | * | 6/1953 | Agee | D7/408 |
| 2,691,369 | A | | 10/1954 | Rutenber | 126/332 |
| 2,766,683 | A | | 10/1956 | Kanz | 99/425 |
| 2,879,708 | A | | 3/1959 | Cripe | 99/342 |
| 3,453,949 | A | * | 7/1969 | Levin | 99/446 |
| 3,538,907 | A | | 11/1970 | Bowman et al. | 126/38 |
| 3,625,196 | A | * | 12/1971 | Craver | 126/239 |
| 3,679,467 | A | * | 7/1972 | Betzer | 428/450 |
| 3,684,087 | A | * | 8/1972 | Anderson | 206/542 |
| 3,797,375 | A | | 3/1974 | Cerola | 99/340 |
| 3,871,356 | A | * | 3/1975 | Saponara | 126/215 |
| 4,042,806 | A | | 8/1977 | McCartney | 219/447 |
| 4,089,321 | A | * | 5/1978 | Ondrasik, II | 126/215 |
| D255,413 | S | * | 6/1980 | Alexander | D7/409 |
| 4,311,451 | A | | 1/1982 | Matumoto et al. | 431/352 |
| 4,409,954 | A | * | 10/1983 | Berlik et al. | 126/39 M |
| 4,583,941 | A | | 4/1986 | Elperin et al. | 431/347 |
| 4,677,964 | A | | 7/1987 | Lohmeyer et al. | 126/41 |
| 4,773,319 | A | | 9/1988 | Holland | 99/446 |
| 5,145,361 | A | | 9/1992 | Kurzinski | 432/19 |

(Continued)

FOREIGN PATENT DOCUMENTS

EP 0 371 715 A1 11/1989

(Continued)

*Primary Examiner*—Steve McAllister
*Assistant Examiner*—Chuka C Ndubizu
(74) *Attorney, Agent, or Firm*—Taylor & Aust, PC

(57) ABSTRACT

A cook top includes a one-piece drip pan beneath all burners for collecting spillage and drips originating at the burners. Burner assemblies having burners therein are located by and supported on the drip pan. Grates are provided above the burners and have chamfered flame-facing surfaces.

10 Claims, 7 Drawing Sheets

U.S. PATENT DOCUMENTS

| | | | | | |
|---|---|---|---|---|---|
| 5,215,074 | A | * | 6/1993 | Wilson et al. | 126/214 R |
| 5,336,084 | A | | 8/1994 | Long | 431/354 |
| D353,300 | S | * | 12/1994 | Edman et al. | D7/408 |
| 5,456,163 | A | | 10/1995 | Ceravolo | 99/446 |
| 5,713,265 | A | | 2/1998 | Strader et al. | 99/446 |
| 5,873,713 | A | | 2/1999 | Osterhues | 431/354 |
| D414,654 | S | | 10/1999 | Epps | D7/402 |
| 6,023,051 | A | * | 2/2000 | Fellows | 219/450.1 |
| 6,092,518 | A | | 7/2000 | Dane | 126/214 |
| 6,345,768 | B1 | | 2/2002 | Inagaki | 236/15 |
| 6,492,622 | B2 | | 12/2002 | Melson et al. | 219/412.11 |
| 6,570,135 | B2 | | 5/2003 | Gros et al. | 219/396 |
| 6,619,280 | B1 | | 9/2003 | Zhou | 126/39 |

FOREIGN PATENT DOCUMENTS

| | | | |
|---|---|---|---|
| EP | 0 583 555 | A1 | 5/1993 |
| EP | 0 612 494 | A1 | 2/1994 |
| EP | 0 793 058 | A2 | 2/1997 |
| EP | 0 801 269 | A2 | 3/1997 |
| JP | 58-69328 | | 4/1983 |
| JP | 63-251726 | | 10/1988 |
| JP | 4-116319 | | 4/1992 |
| JP | 10-227418 | | 2/1997 |
| JP | 10-185205 | | 7/1998 |
| JP | 11-141814 | | 5/1999 |
| JP | 11-299652 | | 11/1999 |
| JP | 2000-304284 | | 11/2000 |
| JP | 2001-65817 | | 3/2001 |
| JP | 2000-249703 | | 10/2001 |
| TW | 41-4847 | | 12/2000 |
| WO | WO 92/04112 | | 3/1992 |
| WO | WO 97/41740 | | 11/1997 |
| WO | WO 03/096857 | A1 | 11/2003 |

* cited by examiner

COOKING RANGE ASSEMBLY AND MONOLITHIC DRIP PAN

FIELD OF THE INVENTION

The present invention relates to cooking appliances and, more particularly, to gas-fired cooking ranges and commercial cook tops and the assemblies therefore.

BACKGROUND OF THE INVENTION

A variety of styles and configurations for cooking ranges have been used in both residential and commercial kitchens. Gas-fired ranges with open cooking flames are widely accepted. A basic design for a gas-fired cook top includes a frame supporting an outer skin and internal components including one or more burner assemblies and a gas manifold supplying gas to the one or more burner assemblies. A grate is provided above the burner assembly, with a drip bowl around the burner assembly for catching spills or boil-overs from cooking vessels used above the grates. A drip pan assembly including a variety of pieces welded or otherwise fitted together is provided beneath the burner assemblies to catch and retain overflowing from the drip bowls. Multi-component burner assemblies secured to the frames are known.

Commercial kitchens commonly experience food spills and boil overs in and around the range from foods being prepared on the range. While the drip bowls around the burner are successful in catching and retaining some of the spillage, it is common that spillage will flow over or through the drip bowls and accumulate on the structures beneath the burner assemblies. This structure, sometimes referred to as the "bathtub." is known to be provided as a fabrication from multiple pieces welded, riveted or otherwise fastened together.

Sanitation, safety and efficient burner performance require that the cook top be kept clean. In commercial kitchens, daily disassembly and cleaning may be required. It is known for the grates and drip bowls around the burners to be readily removable from the frame. However, it is known for the burner assemblies to be physically attached or connected within the range, with removal being difficult. Further, because the bathtub beneath the burners has been provided as a fabrication of multiple components, cleaning is difficult in that ridges and seams catch and retain spillage and are difficult to clean.

What is needed in the art is a range or cook top that can be assembled and disassembled quickly and easily in a precise and accurate manner for efficient cleaning and safe operation. From the drip pan or bath tub out, components should be supported one on the other and precisely located without the need for fasteners or complex procedure for re-installation.

SUMMARY OF THE INVENTION

The present invention provides a cooking range assembly with a one-piece, monolithic bathtub having sides defining a retention zone for collecting spillage. Burner assemblies, burner bowls and cooking grates are supported one above the other and located without the need for fasteners to physically attach one to the other.

In one aspect thereof, the present invention provides a cooking range with a monolithic drip pan defining a seamless reservoir having a bottom and sides, with curved transitions between the bottom and the sides and between adjacent sides. A plurality of burners is provided above the drip pan, and at least one grate supports cooking vessels.

In another aspect thereof, the present invention provides a drip pan for a cooking range having a plurality of burner assemblies. The drip pan has a monolithic body of sufficient size to span an area beneath the burner assemblies. The monolithic body defines a seamless reservoir for collecting spillage. The reservoir includes a bottom, sides and curved transitions between the bottom and the sides, and between adjacent sides.

In a further aspect thereof, the present invention provides a cooking range with a frame and a drip pan secured to the frame. The drip pan has a bottom and sides defining a reservoir for collecting spillage. The bottom and sides are a monolithic, seamless structure from a single piece of material, and have curved transitions between the bottom and the sides and between adjacent sides. A burner assembly is located by and supported on the pan; and a removable grate is supported by the frame above the burner.

In yet another aspect thereof, the present invention provides a grate for supporting a cooking vessel above a burner. The grate is an open network of vessel supporting elements. Flame-facing surfaces of the elements are chamfered. At least some of the elements are arms having distal ends arranged with respect to each other to define a circle of which the arms are non-radial.

Other features and advantages of the invention will become apparent to those skilled in the art upon review of the following detailed description, claims and drawings in which like numerals are used to designate like features.

Figure 1:
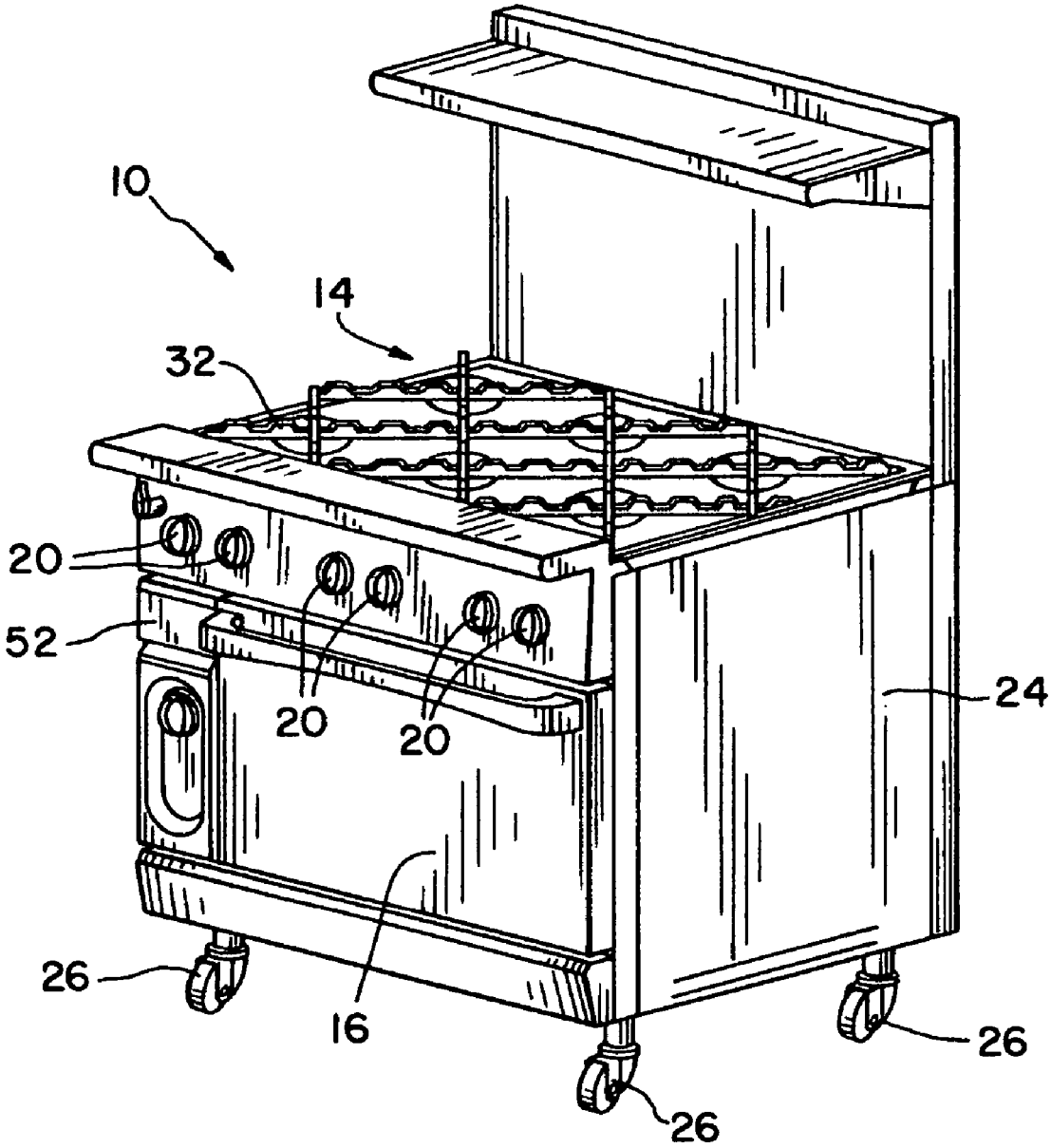
FIG. 1 is a perspective view of a cooking range assembly having a monolithic drip pan in accordance with the present invention.
Figure 2:
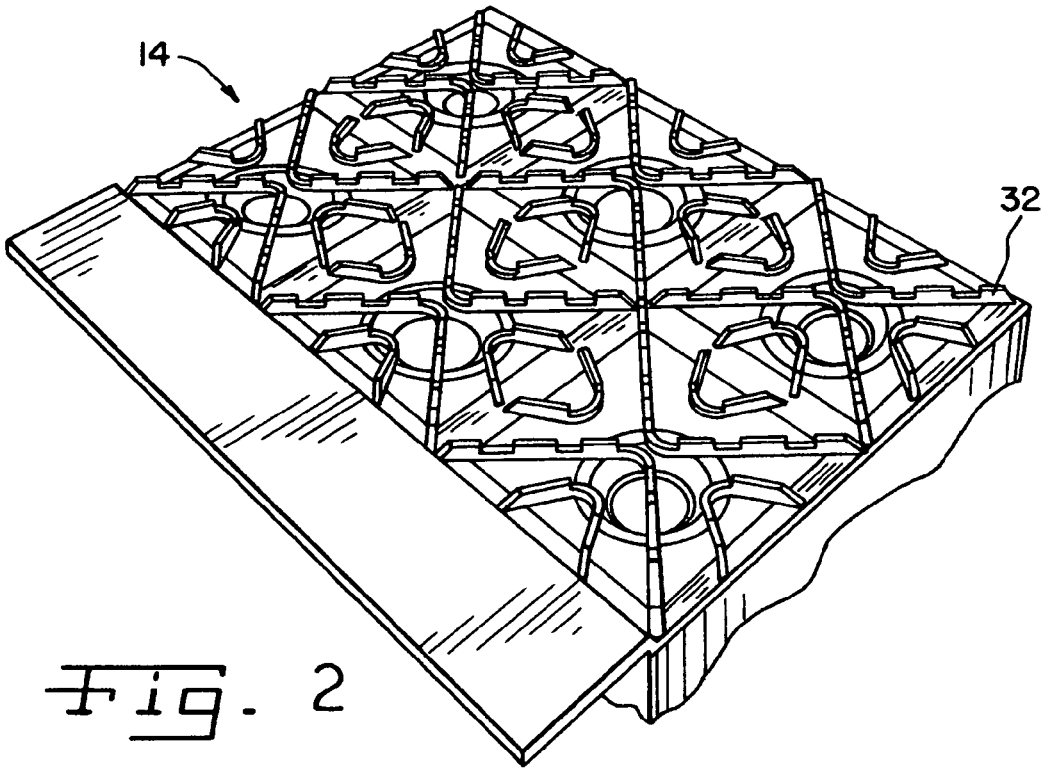
FIG. 2 is a perspective view of the cook top for the range shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 3:
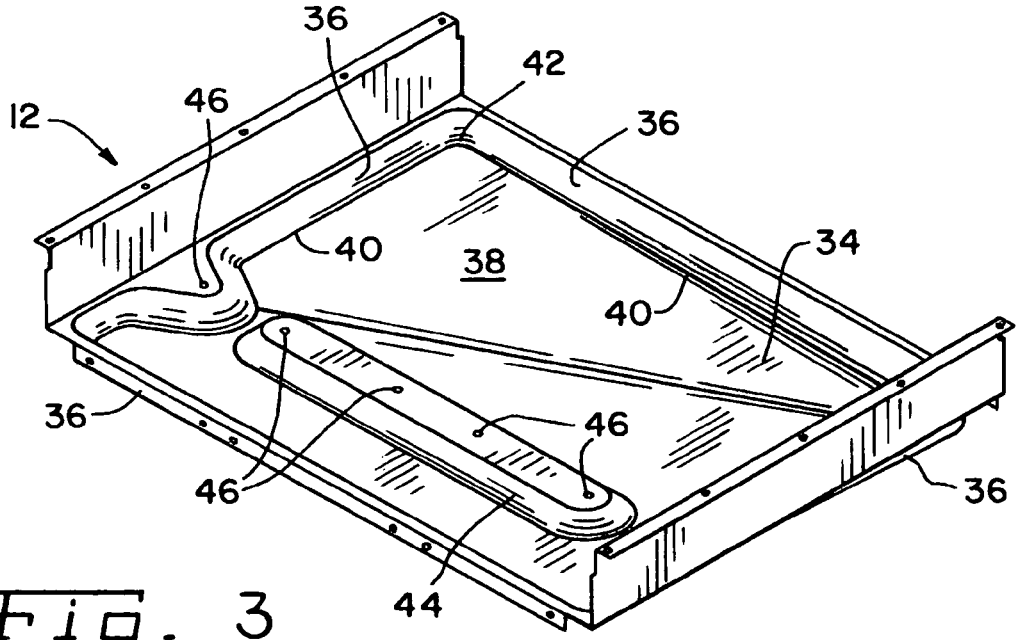
FIG. 3 is a perspective view of the monolithic drip pan for the cook top shown in FIG. 2.

Referring now more specifically to the drawings and to FIG. 1 in particular, numeral 10 designates a cooking range having a monolithic drip pan 12 (FIG. 3) in accordance with the present invention, as part of a cook top 14. Range 10 further includes an oven 16. The present invention is useful for commercial ranges and residential ranges, and the particular outward configuration of range 10 shown in FIG. 1 is merely exemplary.

Figure 4:
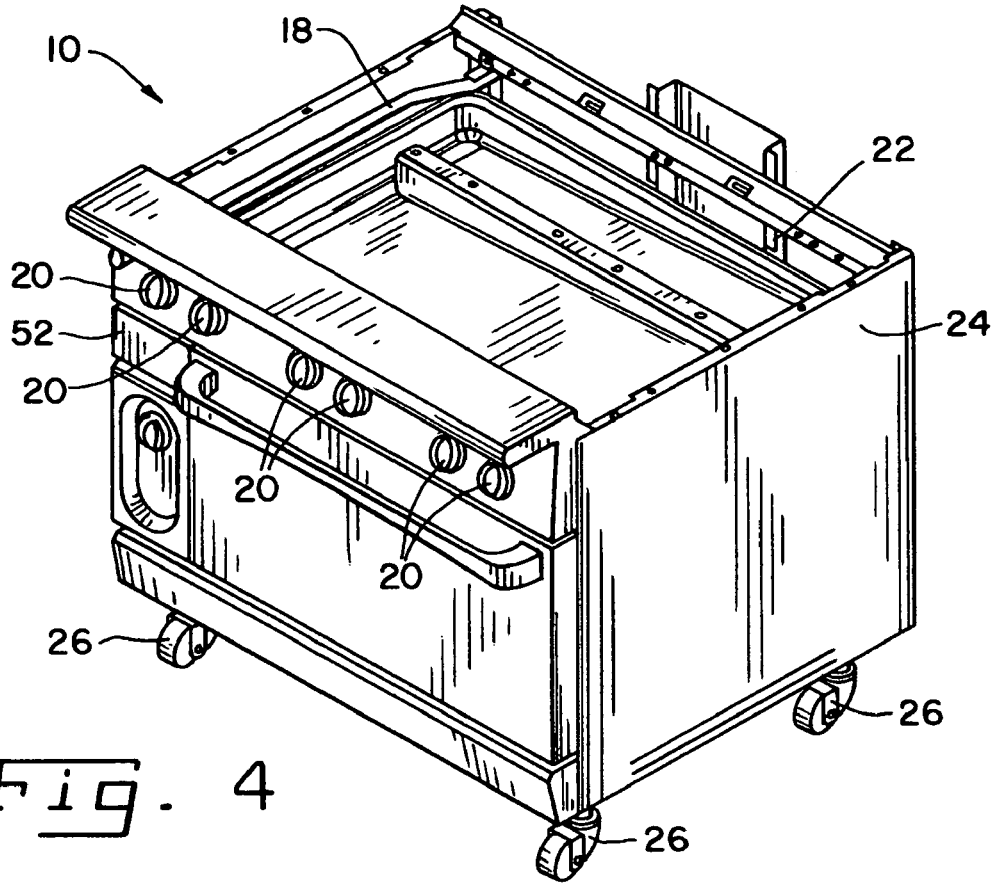
FIG. 4 is a perspective view of a second form of the drip pan installed in a range.

Range 10 is a gas fired range, having gas circuit 18 (FIG. 4) for supplying combustible gas to the various cooking locations on cook top 14, and to heat the interior of oven 16. As those skilled in the art will understand readily, gas circuit 18 has a plurality of flow control valves 20 for initiating, terminating and controlling the rate of gas flow to burner locations on cook top 14.

Range 10 has a frame 22 for supporting cook top 14, oven 16 and a variety of outer panels 24. Range 10 is supported on casters 26 by which range 10 can be moved for cleaning the area around the range.

Cook top 14 includes monolithic drip pan 12 and various structures thereabove for providing individual cooking locations on the upper portion of range 10. Accordingly, cook top 12 includes a plurality of burner assemblies 30, and a network of grates 32 above the burner assemblies for supporting cooking vessels (not shown) such as pots, pans, griddles and the like on cook top 14.

Drip pan 12 is a monolithic structure formed by stamping or the like from a single piece of material. Drip pan 12 has a bottom 34 and a plurality of sides 36 defining an open top reservoir 38 for accumulating spillage and the like originating thereabove. Formed by stamping or the like, drip pan 12 has curved transitions 40 formed between bottom 34 and sides 36. Further, curved transitions 42 are provided between adjacent sides 36. Thus, with curved transitions 40, 42 between sides 36 and bottom 34 and between adjacent sides 36, monolithic drip pan 12 can be cleaned easily by wiping. Spillage accumulating within reservoir 38 is readily removed because of the smooth features defining reservoir 38, with no seams, overlaps or sharp corners from which spillage would be difficult to clean.

Bottom 34 defines one or more intermediate projections 44 rising therefrom within reservoir 38 for supporting burner assemblies 30. Curved transitions 40 are provided also between projection 44 and bottom 34. One or more side 36 and projection 44 have depressions 46 therein for receiving and locating burner assemblies 30. In the exemplary embodiment, a single elongated projection 44 is provided having a plurality of depressions 46 for locating the three-burner assemblies 30 shown. However, those skilled in the art should readily understand that, rather than a single elongated projection 44, a plurality of individual projections 44 can be used, each having only one or several depressions 46 for locating a single burner assembly 30.

Figure 8:
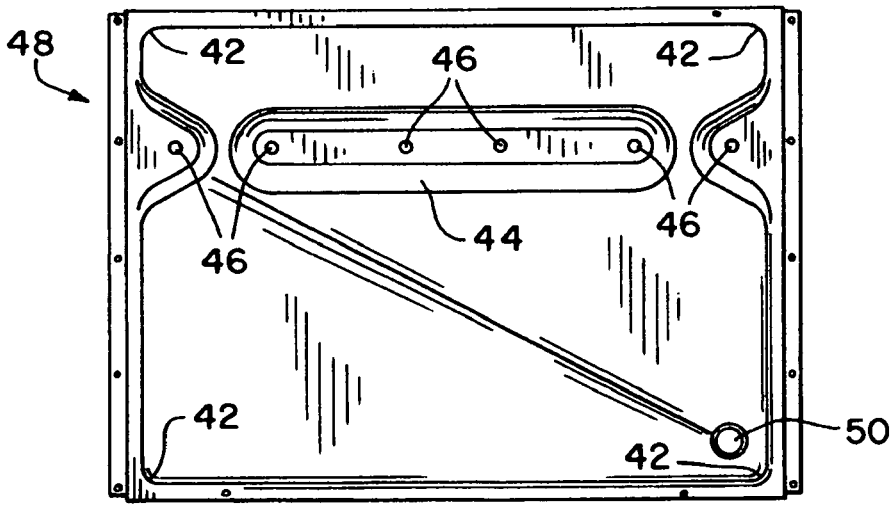
FIG. 8 is a bottom view of the modified form of drip pan.

FIG. 8 illustrates a second embodiment of monolithic drip pan 48 having similar sides 36 and bottom 34. However, bottom 34 in drip pan 48 defines an outlet 50 from which fluids that accumulate in reservoir 38 can be drained. Bottom 34 slopes toward outlet 50 so that liquids accumulating in reservoir 38 will readily drain toward outlet 50. In one embodiment, range 10 may be provided with a grease drawer 52 located beneath outlet 50 such that fluids that drain through outlet 50 are collected in grease drawer 52. Drawer 52 can be removed easily for cleaning. In some embodiments, drip pans 12, 48 are removable to facilitate cleaning by allowing the pan to be removed and taken to a sink or other location when cleaning is required.

A variety of suitable heat resistant and strong materials can be used for monolithic drip pans 12 and 48. However, as those skilled in the art will readily understand, steel having a coating of porcelain thereon is suitable.

Figure 5:
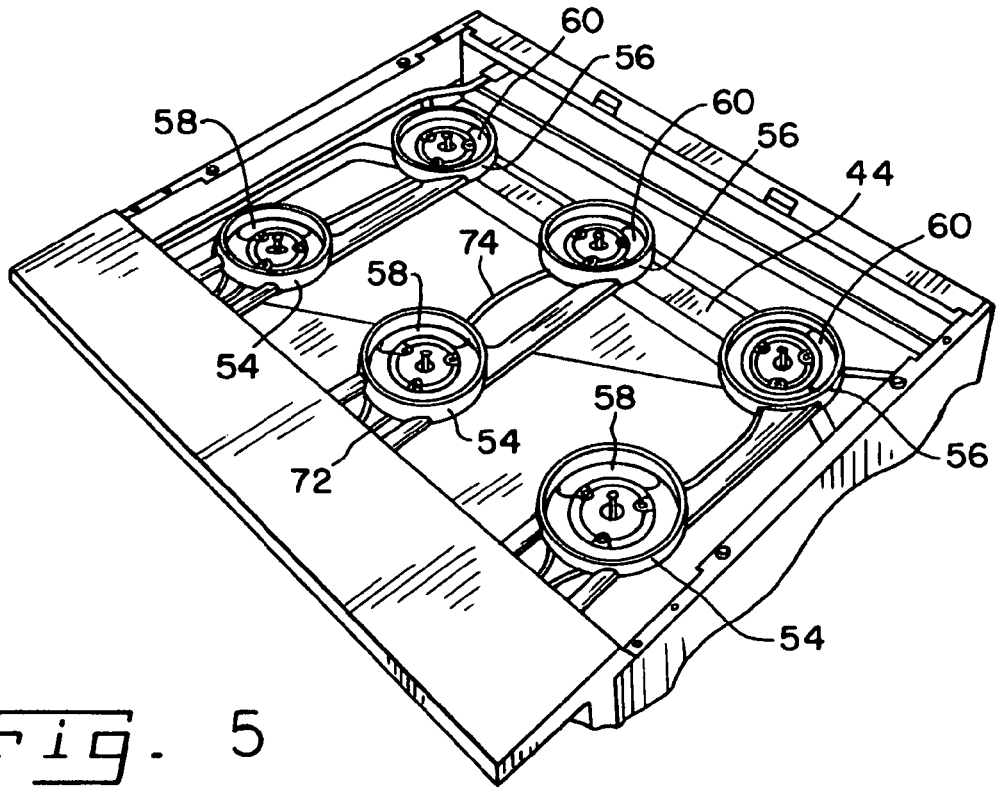
FIG. 5 is a perspective view of a cook top assembly of the present invention, shown in a partial state of assembly.
Figure 6:
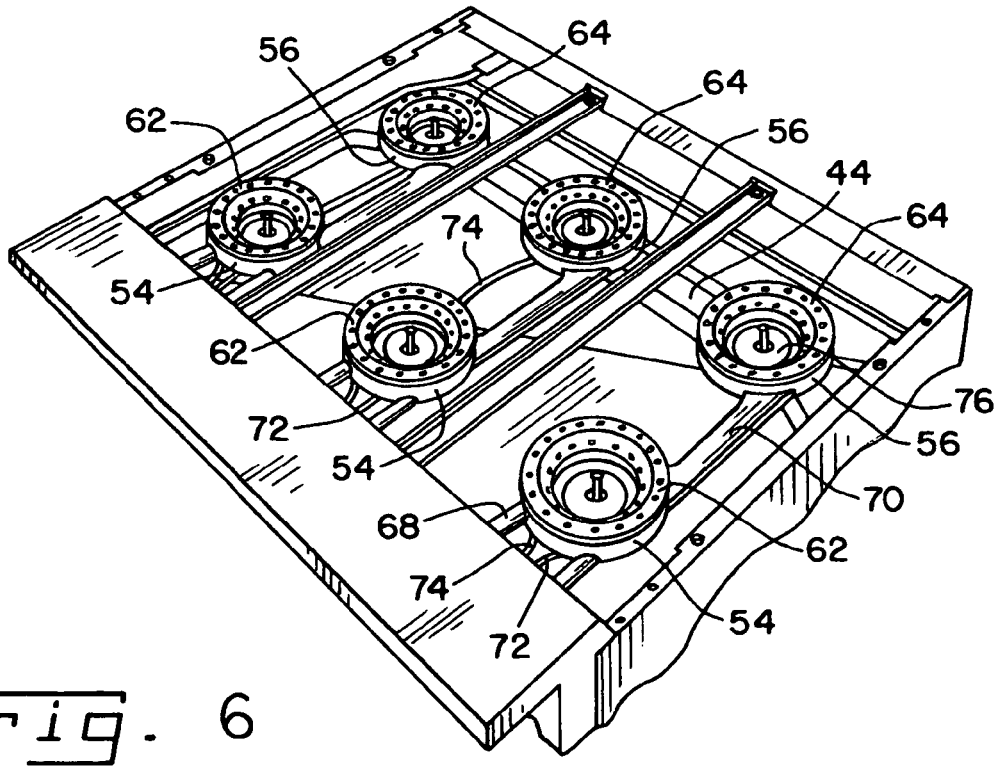
FIG. 6 is a perspective view similar to FIG. 5, but depicting a further state of assembly.
Figure 7:
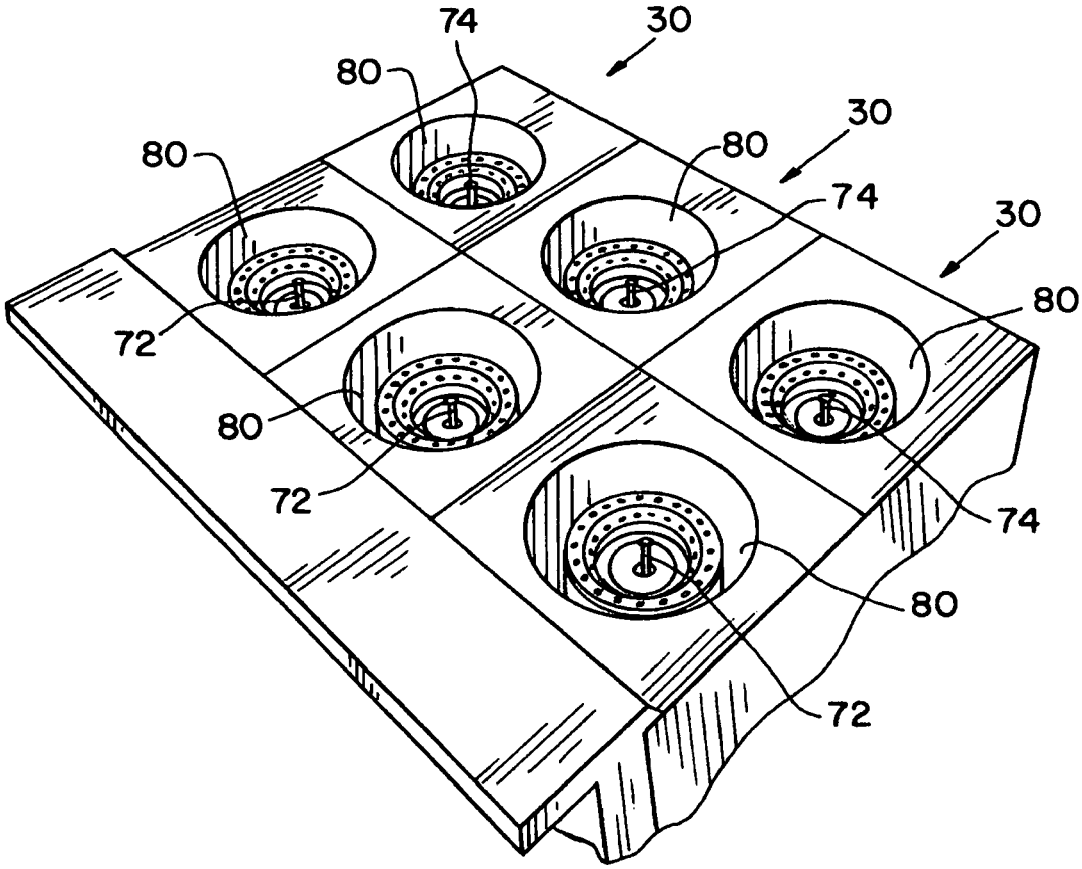
FIG. 7 is a perspective view of yet a further state of assembly for the cook top shown in the preceding Figs.

Burner assemblies 30 illustrated most clearly in FIGS. 5 & 6 are advantageous structures each having two burner heads 54, 56. Thus, only three burner assemblies 30 are required to provide six cooking locations on cook top 14. However, it should be understood that separate individual burner assemblies can be provided for each cooking location. Thus, if six cooking locations are provided on cook top 14, six separate burner assemblies can be used, each having only a single burner head associated therewith.

Burner heads 54, 56 are substantially annular bodies defining open top annular channels 58, 60, respectively (FIG. 5). Burner head covers 62, 64 (FIG. 6) are provided on heads 54, 56, respectively. Each cover 62, 64 has a plurality of apertures 66 therein through which a mixture of combustible gas and primary combustion air is emitted. For clarity, only some apertures 66 and not all apertures 66 are identified with a reference numeral in FIG. 6.

Burner assembly 30 has a single piece, monolithic casting forming a first venturi 68 and a second venturi 70 together with burner heads 54, 56. The monolithic casting of burner assembly 30 can be provided with feet, projections or the like to settle into depressions 46, for locating and supporting burner assembly 30 in drip pan 12. First venturi 62 and second venturi 64 provide a flow of gas and primary combustion air for combustion at burner heads 54, 56, respectively, in front and back locations, respectively, on cook top 14. As known to those skilled in the art, each venturi 68, 70 is aligned with and supported by a different control valve 20 to receive gas therefrom when the control valve 20 is opened to allow gas to flow therethrough. As illustrated, first venturi 68 and second venturi 70 are configured with burner heads 54, 56 to swirl the combustion mixture in opposite directions with respect to each other. In the embodiment shown, first venturi 68 is configured with head 54 to swirl the gas in a clockwise direction, and second venturi 70 is configured with head 56 to swirl the combustion gas in a counter-clockwise direction. It should be understood that the rotational directions within heads 54, 56 can be reversed or can be both in the same direction, either clockwise or counter-clockwise.

Each burner head 54, 56 is provided with a small standing flame or pilot light to ignite the gas mixture at burner head 54, 56 when control valve 20 is opened. Thus, one pilot light system is provided for each burner assembly 30, and includes a first pilot gas tube 72 and a second pilot gas tube 74 having pilot burners at ends thereof operatively associated with burner heads 54, 56, respectively. A secondary air flow restrictor plate 76 is provided in the central opening of each burner head 54, 56, and defines a slot 78 for holding pilot tubes 72, 74.

Each burner assembly 30 and its associated pilot light system of pilot tube 72, 74 are mutually joined and can be installed in and removed from cook top 14 in unison. Thus, cleaning monolithic drip pans 12, 48 is facilitated in that the drip pan is completely exposed. Since depressions 46 locate and support burner assemblies 30, re-assembly is quicker than with known configurations in which burner assemblies and pilot light systems are separate, requiring separate, individual removal and re-installation.

Figure 12:
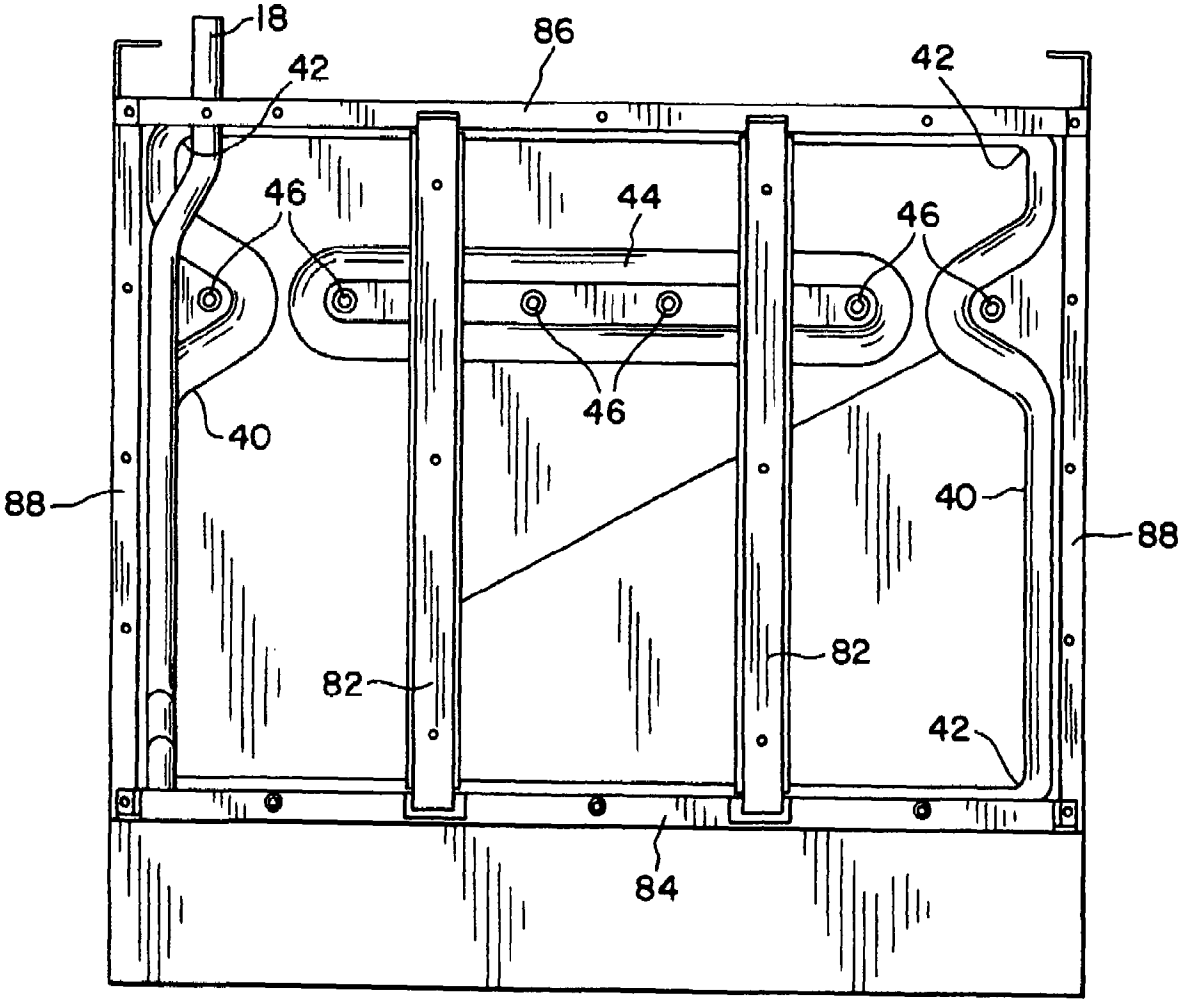
FIG. 12 is a top view of an installed drip pan, but with the burner assemblies removed.

In the assembled range 10, with burner assemblies 30 positioned by drip pan 12, a burner bowl 80 is provided around each burner head 54, 56. Thus, in the configuration shown having six burner heads 54, 56 provided by three burner assemblies 30, six burner bowls 80 are provided. Grates 32 are provided on top of burner bowls 80 for supporting cooking vessels (not shown). One or more support 82 (FIG. 6) is provided beneath burner bowls 80 and grates 32, with the one or more support 82 engaging frame 22. In the embodiment shown in FIG. 12, supports 82 engage front and rear channel members 84, 86 of frame 22, and are readily removable therefrom for cleaning. Supports 82 are spaced from side walls 88 of drip pan 12. Burner bowls 80 and grates 32 are held between a side wall 88 and a support 82, and between the two spaced supports 82.

Figure 11:
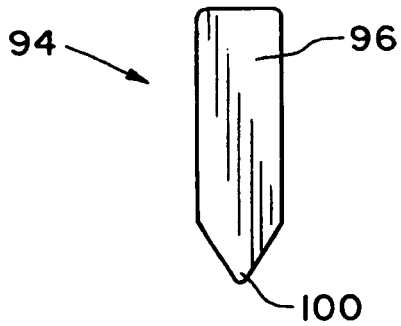
FIG. 11 is an elevational end view of one of the vessel supporting arms of the grate shown in FIG. 10.
Figure 9:
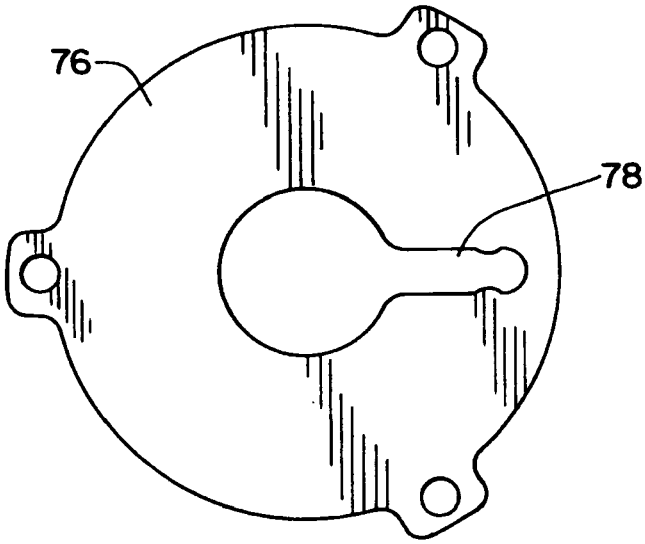
FIG. 9 is a plan view of a restrictor plate for a burner assembly of the cook top.
Figure 10:
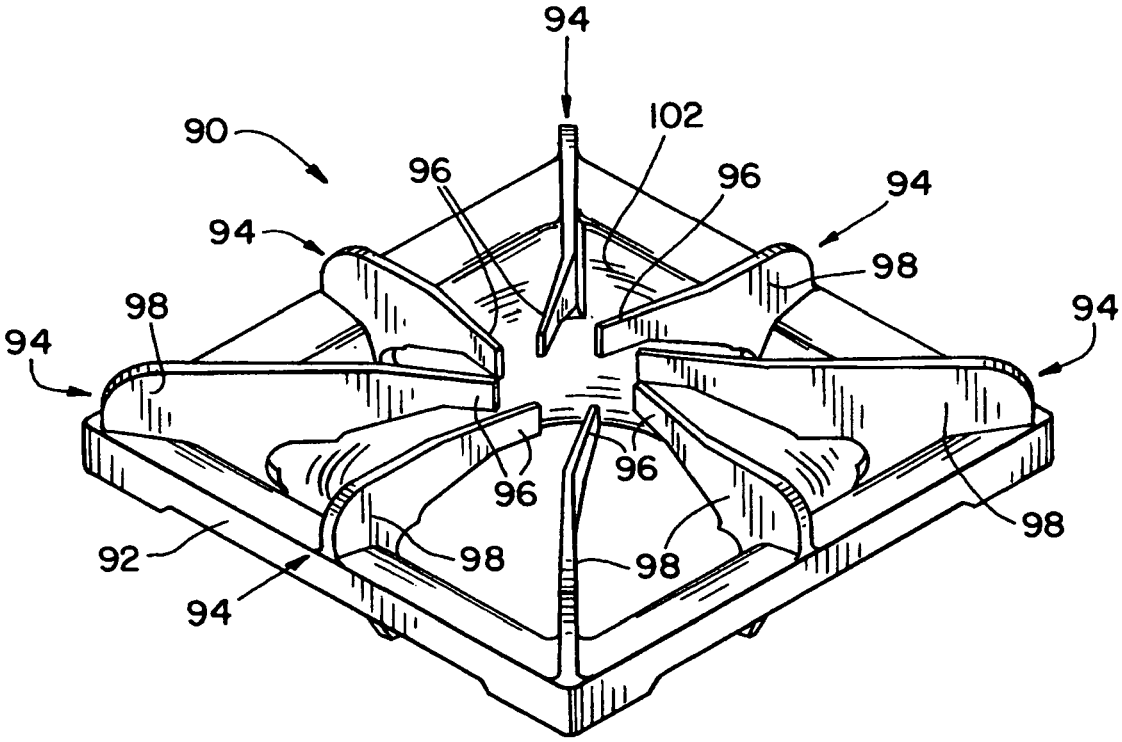
FIG. 10 is a perspective view of one advantageous form of grate in accordance with the present invention.

FIGS. 10 and 11 illustrate an advantageous embodiment of a grate 90. One grate 90 is provided above each burner head 54, 56. Each grate 90 includes an outer frame 92 and a plurality of vessel supporting arms 94. Arms 94 extend inwardly from frame 92 and have distal segments 96 angled with respect to base segments 98 thereof. The tips of distal segments 96 together define a circle of which distal segments 96 are non-radial. It should be understood that other types of grates also can be used.

As illustrated in FIG. 11, lower edges 100 of flame facing surfaces are chamfered. By chamfering lower flame facing edges 100, significant horizontal surfaces are eliminated, which could collect spillage. Further, the lower chamfered surfaces 100 allow flames to rise smoothly therearound, uninterrupted toward a vessel supported thereon for rapid heating of the vessel and contents within the vessel.

Grate 90 includes an integral burner bowl portion 102 below arms 94, so that a separate burner bowl 80 is not required. Combining the grate and burner bowl into a single piece reduces the number of separate components that must be removed and re-installed during cleaning.

The present invention provides a range that can be disassembled and re-assembled quickly and easily for cleaning. The design of the drip plan facilitates through cleaning by eliminating crevices that can collect spillage.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A cooking range comprising:

a monolithic drip pan defining a seamless reservoir having a bottom and sides, said bottom defining an intermediate projection rising into said reservoir, with curved transitions between said bottom and said sides, between said bottom and said intermediate projection and between adjacent sides;

a plurality of burners above said drip pan, said burners being detached from while supported on said drip pan, said drip pan of sufficient size to span an area beneath said burners;

burner locating and supporting configurations in said drip pan including burner receiving and locating depressions in said sides and in said intermediate projection;

at least one grate above at least one of said burners for supporting cooking vessels; and said at least one grate and said plurality of burners being removable from said range separately and independently from said drip pan, and said drip pan being exposed for cleaning while remaining in said range upon removal of said at least one grate and said plurality of burners.

2. The cooking range of claim 1, said burners each including at least one venturi and a burner head supported on said drip pan.

3. The cooking range of claim 1, said burners each including two venturis and associated burner heads supported on said pan.

4. The cooking range of claim 3, said range including three said burners.

5. The cooking range of claim 1, said drip pan bottom defining a drain outlet, with said bottom sloping toward said outlet, and said range further including a removable catch basin beneath said drain outlet.

6. The cooking range of claim 1, said pan being steel.

7. The cooking range of claim 6, said pan having an interior surface coated with porcelain.

8. The cooking range of claim 1, each said burner including first and second venturis formed as a monolithic structure, each said first and second venturi having a burner head associated therewith.

9. A drip pan for a cooking range having a plurality of burner assemblies, said drip pan comprising:

a monolithic body of sufficient size to span an area beneath the burner assemblies;

said monolithic body defining a seamless reservoir for collecting spillage, said reservoir including:

a bottom;

sides;

curved transitions between said bottom and said sides, and between adjacent said sides;

said bottom defining an intermediate projection rising into said reservoir;

curved transitions between said bottom and said intermediate projection; and burner locating and supporting configurations including burner receiving and locating depressions in said sides and in said intermediate projection.

10. The drip pan of claim 9, said bottom defining a drain outlet.

* * * * *